United States Patent [19]

Salinier et al.

[11] Patent Number: 4,645,973

[45] Date of Patent: Feb. 24, 1987

[54] HYPERFREQUENCY ENERGY PLASMA TORCH

[75] Inventors: Guy Salinier, Paris; Jean-Paul Bossard, Fontenay-le-Fleury, both of France

[73] Assignee: L'Air Liquide, Societe Anomyme pour l'Etude et l'Exploitation des Procedes Georges Claude, Paris, France

[21] Appl. No.: 656,909

[22] Filed: Oct. 2, 1984

[30] Foreign Application Priority Data

Oct. 3, 1983 [FR] France ..... 83 15713

[51] Int. Cl.[4] ..... H01J 7/46; H01J 7/24

[52] U.S. Cl. ..... 315/39; 315/40; 315/111.01; 315/111.21; 315/111.31

[58] Field of Search ..... 315/39, 111.31, 40, 315/41, 111.21, 111.01

[56] References Cited

U.S. PATENT DOCUMENTS 2,964,678 12/1960 Reid ..... 315/111.21
3,280,364 10/1966 Sugawara et al. ..... 315/39
3,641,389 2/1972 Leidigh ..... 315/39
3,911,318 10/1975 Spero et al. ..... 315/39
4,517,495 5/1985 Piepmeier ..... 315/111.21

FOREIGN PATENT DOCUMENTS 969831 1/1964 United Kingdom ..... 315/111.21

OTHER PUBLICATIONS

J. Swift, "A Microwave Plasma Torch", *Electronic Engineering*, vol. 38, No. 457, Mar. 1966, Londres, Great Britain, pp. 152–154, figure 1.

*Primary Examiner*—David K. Moore
*Assistant Examiner*—M. Razavi
*Attorney, Agent, or Firm*—Young & Thompson

[57] ABSTRACT

The hyperfrequency energy is conveyed through a waveguide (1) having a rectangular section. A central plasmagenic gas and an annular sheathing gas are supplied through a T-shaped transverse pipe (2). The upper branches of the T extend in a sealed manner through the small sides of the waveguide. The stem of the T extends with clearance through an opening (7) formed in a large side of the waveguide and is provided with a nozzle (22) which is surrounded by a sleeve (3) terminating in a rolled-over flange (25). Application in the treatment of surfaces and the production of chemical reactions.

11 Claims, 2 Drawing Figures

HYPERFREQUENCY ENERGY PLASMA TORCH

The present invention relates to a plasma torch of the type comprising a waveguide adapted to be connected to a microwave generator, and a gas supply conduit which has a downstream part which extends through an opening of the waveguide with clearance and is connected to a nozzle.

Torches of this type, which have been recently proposed, provide at the outlet of the pipe a stable plasma in a central plasmagenic gas stream, which may be sheathed by an annular stream of another gas, or in an annular stream of plasmagenic gas which may surround a central stream of another gas. However, these known torches have not permitted reaching sufficient power to envisage their use in industry.

An object of the invention is to provide a plasma torch which is simple in construction and is capable of satisfying this need.

The invention therefore provides a plasma torch of the aforementioned type, wherein the supply conduit has a generally T-shape whose stem constitutes said downstream part, a first upper branch of the T extending without clearance through a lateral orifice of the waveguide and being adapted to be connected to a source of gas, while the second upper branch of the T extends to the lateral wall of the waveguide opposite said orifice and is closed.

In an embodiment which still further increases the power of the torch and enables the latter to be used in a large number of various applications, in the downstream part of the conduit there is disposed a central conduit connected to a conduit supplying a second gas, this supply conduit being disposed coaxially in one of the upper branches of the T and being connected to the central conduit by an elbow.

One embodiment of the invention will now be described with reference to the accompanying drawings, in which.

Figure 1:
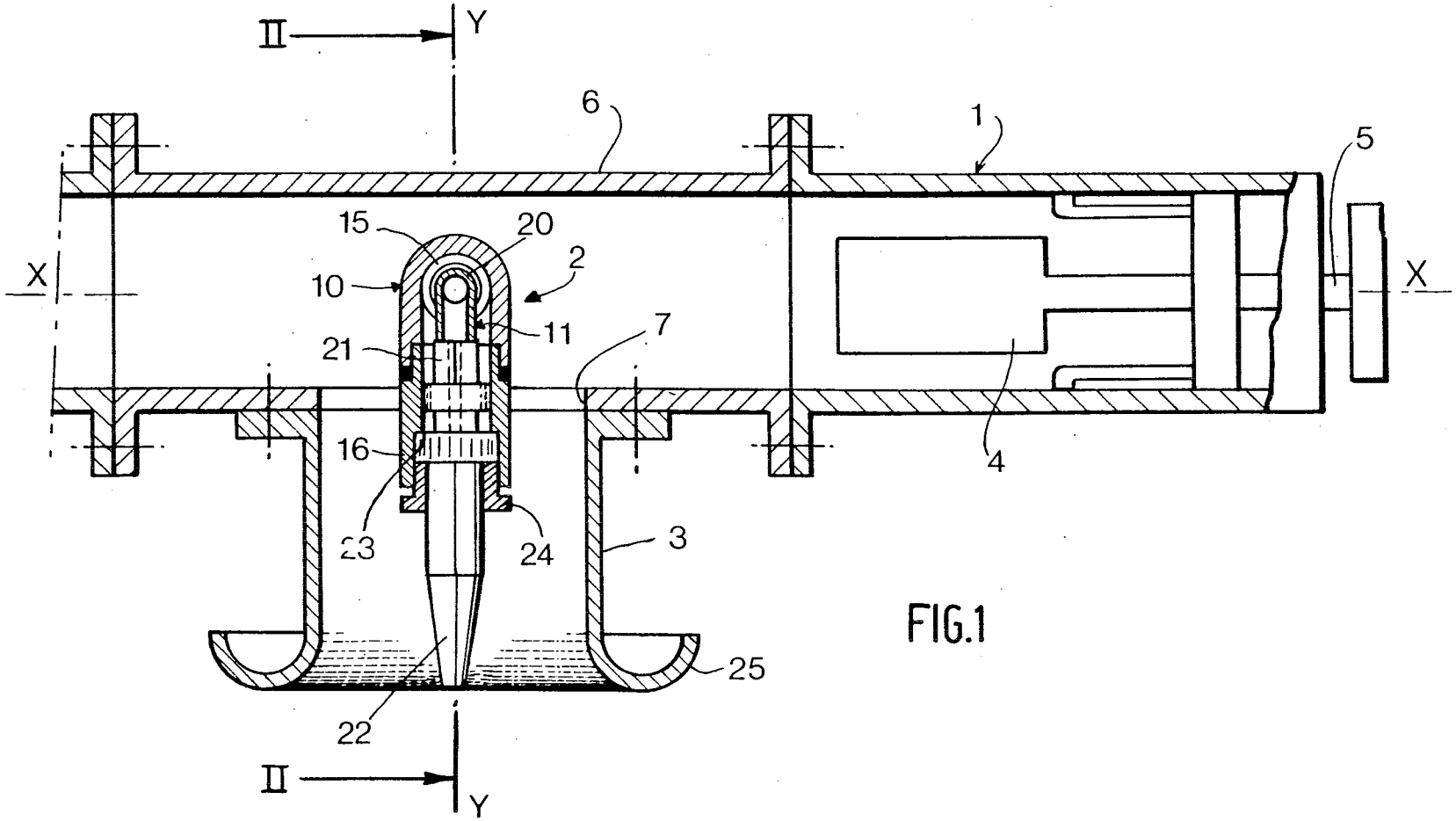
FIG. 1 is a sectional view of a plasma torch according to the invention taken along line I—I of FIG. 2.

The plasma torch shown in the drawings comprises mainly a waveguide 1, a gas supply pipe 2 and a sleeve 3, all these elements being of metal.

Figure 2:
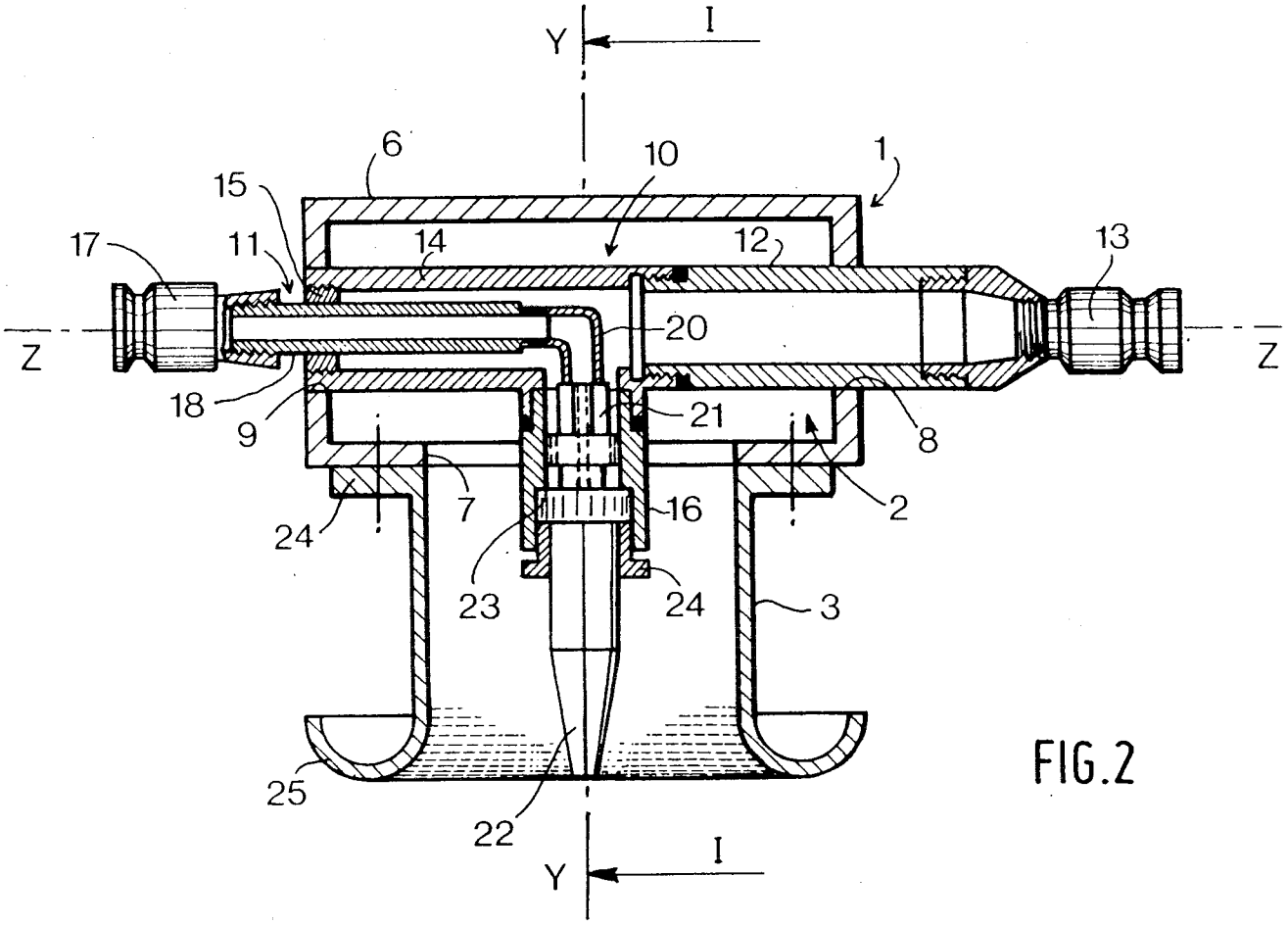
FIG. 2 is a sectional view taken along line II—II of FIG. 1.

The waveguide 1 is rectilinear and has a rectangular section shown in FIG. 2. It extends from a microwave generator (not shown and located at the left as viewed in FIG. 1) to an end which is closed by a quarter-wave-trap 4 which is adjustable in position by a slidable rod 5 which extends out of the end of the waveguide. Such traps are well-known in the hyperfrequency art and need not be described in detail. For convenience of the description, it will be assumed that the axis X—X of the waveguide is horizontal as are the large sides of the rectangular section of this waveguide.

The waveguide 1 includes a removable intermediate section 6 whose lower side has a circular opening 7 having a vertical axis Y—Y and whose lateral sides have two circular orfices 8 and 9 respectively. The orifices 8 and 9 have the same diameter less than the diameter of the opening 7 and are in alignment on a common horizontal axis Z—Z. The axes X—X, Y—Y and Z—Z intersect at the centre of the section of the waveguide located in the plane of symmetry of the section 6.

The supply pipe 2 is adapted to convey two different gases respectively through an exterior conduit 10 and an interior conduit 11.

The exterior conduit 10 has a generally T-shape. An upper branch 12 of the T, having an axis Z—Z, extends through the orifice 8 in a sealed manner and terminates in a coupling 13 for connection to a source (not shown) of a first gas. The other upper branch 14 of the T, which also has an axis Z—Z, has its end portion fitted in a sealed manner in the orifice 9 and is hermetically closed by a washer 15. The stem 16 of the T extends coaxially through the opening 7 with a large clearance.

The interior conduit 11, provided with a coupling 17 for connection to a source (not shown) of a second gas, comprises an upstream part 18 having the axis Z—Z and extending through the washer 15 in a sealed manner, an elbow 20, and a downstream part 21 having the axis Y—Y. The part 21 includes a collar which is axially apertured so that it is centered in the stem 16 of the T and allows the passage of the first gas.

The whole of the pipe 2 can consist, as shown, of a succession of tubular elements which are screwed together, fluidtightness being preferably achieved by welds. Screwed on the lower end of the stem 16 is a nozzle 22 having a conical nose of conventional type in oxygen cutting, a central conduit of which communicates with the conduit 11 while an annular conduit (or a series or conduits disposed in a ring arrangement) communicates with the conduit 10. The nozzle 22 bears against an interior shoulder 23 of the conduit 10, with interposition of a suitable sealing element (not shown), and is held in position by a nut 24 screwed into this conduit.

The sleeve 3 has an inside diameter substantially equal to the diameter of the opening 7. It has at its upper end an outer flange 24 screwed in position around this opening and, at its lower end, a rolled-over flange 25. This flange, which is connected tangentially to the cylindrical wall of the sleeve, can have a contour in the shape of an arc of a circle, as shown. By way of a modification, this flange 25 may be replaced by an outer bead which has a rounded contour and is tangentially connected to the sleeve. The lowermost circle of the flange 25 or bead is substantially in the horizontal end plane of the nozzle 22.

In operation, one of the two couplings 13 and 17 is connected to a source of a plasmagenic gas, for example argon, and the other is connected to a source of another gas adapted to sheath the plasmagenic gas or to be surrounded by the latter at the outlet of the nozzle 22. The microwave generator supplies a pulsating electromagnetic energy, for example at the frequency of 2.45 GHz.

The incident power is divided into a useful power transmitted by the pipe 2 and the nozzle 22 which consititutes an antenna in the absence of gas, and a parasitic reflected power returned by the waveguide 1 to the generator. The applicant has found that, surprisingly, with a suitable adjustment of the trap 4, it was possible to obtain a stable plasma at the outlet of the nozzle 22 with an efficiency, useful power/incident power, on the order of 95% for an incident power ranging up to at least 6 kW. Satisfactory tests have in particular been carried out with a central argon plasma sheathed with compressed air or nitrogen. By eliminating the gas sheath, it was possible to obtain a stable plasma up to an incident power of about 4 kW.

By way of a modification, the exterior cap of the nozzle may be made from a dielectric material (quartz, ceramic, etc.). This permits increasing the power of the torch or, for a given power, reducing the required gas flows. Further, if the torch is intended to operate under conditions which are always identical, the trap 4 may be replaced by a simple planar plate having an axis X—X and connected hermetically to the waveguide.

In another modification, when the conduit 11 conveys a plasmagenic gas, there may be introduced through the branch 12 of the T a gas mixture, for example a combustible mixture, so as to form at the outlet of the nozzle 22 a flame sheathing the central plasma jet. In this case, it may be advantageous, for reasons of safety, to arrange that the gases of the mixture (for example $O_2$ and $H_2$) be conveyed separately up to the outlet of the nozzle 22 and mixed only outside the latter, as is usual with certain types of burners. Suitable pipes and/or partition walls are then provided in the branch 12 and in the stem 16 of the T.

The torch described above may in particular be employed for the treatment of surfaces, for producing chemical reactions or for scientific applications such as analysis operations.

What is claimed is:

1. A microwave plasma torch for creating a plasma jet, comprising: a waveguide for connection to a microwave generator, said waveguide having lateral walls and defining an opening in a first said wall and a lateral orifice in a second said wall adjacent said first wall; a gas supply conduit in the waveguide, the gas supply conduit having a generally T-shape defining a stem, a first upper branch and a second upper branch; said stem of said supply conduit constituting a downstream part of said supply conduit which extends through said opening with clearance and has an open outlet end and is connected to a discharge nozzle, said first upper branch extending on a first side of said stem, through said lateral orifice without clearance and being adapted to be connected to a source of said gas, and said second upper branch being in alignment with said first branch, on a second side of said stem opposite to said first side, and extending to an end portion adjacent a third said lateral wall of said waveguide which is opposed to said second wall; and means closing said end portion of said second upper branch.

2. A plasma torch according to claim 1, wherein said waveguide has a rectangular section and said stem and upper branches are rectilinear and perpendicular to the respective walls of the waveguide.

3. A plasma torch according to claim 2, wherein said first wall forms a large side of said waveguide.

4. A plasma torch according to claim 1, further comprising a central conduit disposed in said stem of said gas supply conduit and a second gas supply conduit connected to said central conduit.

5. A plasma torch according to claim 4, wherein said second gas supply conduit is disposed coaxially in one of said upper branches and an elbow connects said second gas supply conduit to said central conduit.

6. A plasma torch according to claim 5, wherein said second gas supply conduit is disposed coaxially with respect to said second upper branch and extends through said third wall.

7. A plasma torch according to claim 4, wherein said nozzle has an exterior cap of a dielectric material.

8. A plasma torch according to claim 1, wherein said stem of said gas supply conduit is surrounded by a sleeve having an inside diameter which is substantially equal to a diameter of said opening, said sleeve being fixed to said waveguide around said opening.

9. A plasma torch according to claim 8, comprising an outer rolled-over flange on a downstream end of said sleeve.

10. A plasma torch according to claim 8, comprising an outer bead having a rounded contour on a downstream end of said sleeve.

11. A plasma torch according to claim 6, wherein said second gas supply conduit extends through said closing means.

* * * * *